US005804347A

United States Patent [19]

Inoue et al.

[11] Patent Number: 5,804,347

[45] Date of Patent: Sep. 8, 1998

[54] ELECTROPHOTOGRAPHIC TONER AND CONTACT DEVELOPMENT METHOD USING THE TONER

[75] Inventors: Kazushige Inoue; Toru Takatsuna; Yukihiro Mori; Etsuro Nakagawa; Hiroko Higuchi, all of Osaka, Japan

[73] Assignee: Mita Industrial Co., Ltd., Osaka, Japan

[21] Appl. No.: 658,542

[22] Filed: Jun. 5, 1996

[30] Foreign Application Priority Data

| | | | |
|---|---|---|---|
| Jun. 7, 1995 | [JP] | Japan | 7-140803 |
| Aug. 29, 1995 | [JP] | Japan | 7-220495 |
| Nov. 30, 1995 | [JP] | Japan | 7-312825 |

[51] Int. Cl.[6] ..... G03G 9/087; G03G 9/097

[52] U.S. Cl. ..... 430/110; 430/111

[58] Field of Search ..... 430/110, 111

[56] References Cited

U.S. PATENT DOCUMENTS

| | | | |
|---|---|---|---|
| 4,837,393 | 6/1989 | Alexandrovich et al. | 430/110 |
| 4,837,394 | 6/1989 | Alexandrovich et al. | 430/110 |
| 4,840,863 | 6/1989 | Otsu et al. | 430/110 |
| 4,855,396 | 8/1989 | Wilson et al. | 528/272 |
| 4,939,059 | 7/1990 | Kawabe et al. | 430/109 |
| 5,047,305 | 9/1991 | Uchida et al. | 430/110 |
| 5,198,320 | 3/1993 | Vreeland et al. | 430/110 |
| 5,294,682 | 3/1994 | Fukuda et al. | 430/110 |
| 5,380,616 | 1/1995 | Aoki et al. | 430/110 |
| 5,424,161 | 6/1995 | Hayashi et al. | 430/110 |

FOREIGN PATENT DOCUMENTS

| | | |
|---|---|---|
| 0 087 988 | 9/1983 | European Pat. Off. . |
| 0 380 813 | 8/1990 | European Pat. Off. . |
| 0 643 336 | 3/1995 | European Pat. Off. . |
| 0 703 502 | 3/1996 | European Pat. Off. . |
| 2 256 442 | 7/1975 | France . |
| 2 256 443 | 7/1975 | France . |
| 63-49768 | 3/1988 | Japan . |
| 63-56659 | 3/1988 | Japan . |

*Primary Examiner*—Roland Martin

*Attorney, Agent, or Firm*—Beveridge, DeGrandi, Weilacher & Young, L.L.P.

[57] ABSTRACT

This invention provides an electrophotographic toner comprising the polyester resin being fixing resin and the electric charge control resin having the functional group that endows positively charging property to the toner, in which the polyester resin has an acid value of not more than 10 mgKOH/g and a hydroxyl value of not more than 40 mgKOH/g, and the functional group is present in 2 to 5 mol % in the electric charge control resin. This electrophotographic toner has stable positively charging property, so that good image is obtainable.

8 Claims, 3 Drawing Sheets

ELECTROPHOTOGRAPHIC TONER AND CONTACT DEVELOPMENT METHOD USING THE TONER

BACKGROUND OF THE INVENTION

This invention relates to an electrophotographic toner used in image-forming apparatuses such as plain paper facsimiles and laser printers, and to a contact development (impression development) method using the electrophotographic toner, which is applied to the above image-forming apparatuses and the like.

In the field of the image-forming apparatuses employing electrophotographic technique, there have been developing a one-component insulating toner development, particularly a non-magnetic one-component contact development, in place of two-component magnetic brush development employing a magnetic carrier and a toner.

In the non-magnetic one-component contact development, as shown in FIG. 3, a toner 1 being a non-magnetic one-component developer is charged by frictionally charging between a developing roller 2 and a regulating blade 3, and is attached to the surface of the developing roller 2 by the action of image force, so that a thin layer of the charged toner 1 is formed on the developing roller 2.

Then, when the thin layer is allowed to contact with an electrostatic latent image on a photoconductor drum 4, the toner 1 in the thin layer is transferred to the surface of the photoconductor drum 4, according to the potential of the latent image, to develop the electrostatic latent image into a toner image.

In FIG. 3, reference numerals 5, 6, 7 and 8 denote a hopper for supplying toner, an agitator for agitating the toner, a toner supply roller and a developing device, respectively.

The electrophotographic toner used in the non-magnetic one-component contact development is circulated in the developing device while being frictionally contacted with the developing roller 2, the regulating blade 3, the photoconductor drum 4 and the like. Therefore, high durability to the friction is required in the toner. Particularly to avoid the drop in the image quality of the image formed, it is essential to avoid fusion between the toners, which is caused by heat and pressure generated due to the friction, and spent toner which is the fine powder of the toner pulverized by the friction which adheres to the surface of another toner.

Examples of image-forming apparatuses in which severe frictional conditions are imposed upon toners, include middle or high speed image-forming apparatuses and image-forming apparatuses employing a recycling system. In the latter apparatuses, after transferring of toners to the photoconductor drum 4, residual toners not being transferred to a paper is recovered by a cleaner, which are then conveyed to the developing device 8 to be recycled. In these image-forming apparatuses, there have been studying electrophotographic toners in which a sturdy polyester resin is used as a fixing resin, in place of conventional styrene-acrylic resin, since the polyester resin is more sturdy than styrene-acrylic resin.

Japanese Unexamined Patent Publication No. 63-49768 discloses an electrophotographic toner compound whose main component is a linear urethane-denatured polyester resin. This polyester resin is obtained by allowing a linear polyester resin having an acid value of 5 or less, in which the end group is substantially hydroxyl group, to react with a predetermined diisocyanate.

Japanese Unexamined Patent Publication No. 63-56659 discloses an electrophotographic toner composition whose main component is a mixture of a urethane-denatured polyester resin and a polyester resin in which the hydroxyl value is 1 or less and the acid value is 11 to 20 mgKOH/g.

It is, however, difficult to positively charge the conventional polyester resins, because they have higher acid values than the styrene-acrylic resin in view of its chemical structure. Therefore, the toners for the non-magnetic one-component development which employ the polyester resin which has been put into practice, are limited to negative charge type toners. Any positive charge type toners employing the polyester resin have not come in practice.

In the above negative charge type toner, however, the polyester resin has higher acid values as previously mentioned. Accordingly, the moisture resistance is insufficient and the charging property is unstable depending upon temperature and moisture in the environmental conditions in which they are used. As a result, the image density of the formed image is lowered, or inferior image having fog (i.e., toner is adhered to blank spaces in the formed image) is produced, lowering the image-quality.

Particularly when a toner containing the polyester resin as a fixing resin is used in severe environment such as high temperature and high moisture, moisture is adhered to the surface of the toner, so that the amount of charge is decreased and the conductive is increased. Further, when an image formation is carried out using the above toner by the non-magnetic one-component contact development in the environment of high-temperature and high-moisture, fog or the like occurs in the formed image.

In addition, since the electrophotographic toner used in the non-magnetic one-component contact development is exposed to electric field of high voltage, approximately 300 V, at the time of the development, it is required to improve the resistance to such high voltage. A carbon black which is added to the toner as a coloring agent is conductive, and therefore, less carbon black is used compared with the toners for the two-component magnetic brush development. Thus, depending upon the kind of the carbon black, the image density might be lowered.

Examples of the non-magnetic one-component development include the contact development employing reversal development technique in which toners are transferred to an exposure area of a photoconductor drum. This development process has been employed in plain paper facsimiles, laser printers and the like.

In this development process, it is essential that the toner and the photoconductor have the same charge type. However, when a negative charge type photoconductor drum which is combined with the negative charge type toner presently put into practice is charged, a large amount of ozone occur from a charger. It is therefore needed to take means for preventing the ozone from escaping outside, so that the structure of the device is complicated. Moreover, the photoconductor drum deteriorates due to the ozone, shortening the lifetime of the drum.

SUMMARY OF THE INVENTION

It is an object of this invention to provide an electrophotographic toner which exhibits high durability to friction or heat by employing a sturdy polyester resin, and which has the stable positively charging property, even when it is used in severe environmental conditions such as high-temperature and high-moisture, thereby permitting superior image without fog or decrease in image density.

It is another object of this invention to provide a contact development method using the electrophotographic toner.

The above electrophotographic toner comprises a polyester resin and an electric charge control resin containing a functional group that endows positively charging property to the toner. The polyester resin has an acid value of not more than 10 mgKOH/g and a hydroxyl value of not more than 40 mgKOH/g. The functional group is present in 2 to 5 mol % in the electric charge control resin.

The above polyester resin is sturdy or tough enough to secure high durability to friction or heat. Since its acid value is not more than 10 mgKOH/g, toner can positively be charged at high efficiency by the function of the electric charge control resin having positively charging property. Further, since the hydroxyl value of the polyester resin is relatively lower (not more than 40 mgKOH/g), the toner has high moisture resistance.

In the above electric charge control resin, the proportion of the functional group that disturbs the compatibility to the polyester resin is limited to not more than 5 mol %, resulting in high compatibility to the polyester resin. Moreover, the proportion of the functional group is also limited to more than 2 mol %, thereby being superior in retaining the positively charging property.

By employing the electrophotographic toner of this invention, it is therefore possible to obtain images superior in image-quality, without decreasing image density and generating fog which are caused by the fusion, cracking, spent toner and unstable charging property of the toner particle.

When the electrophotographic toner of this invention which is excellent in positively charging property is applied to the image-forming apparatuses which employs the reversal development type contact development, it allows to use the positive charge type photoconductor drum which generates less ozone than the negative charge type, at the time of the charging. This is favorable to the environmental sanitation.

Moreover, the electrophotographic toner of this invention, which employs the chemically stable polyester resin as the fixing resin, has excellent resistance to polyvinyl chloride. The resistance to polyvinyl chloride means the property that when an image formed on a paper is closely contacted with a sheet of soft polyvinyl chloride, the formed image is prevented from being softened due to a plasticizer included in the polyvinyl chloride sheet and then transferred to the sheet.

The electric charge control resin is preferably used in not more than 20 parts by weight for 100 parts by weight of the polyester resin, in order that the electrophotographic toner has the sufficient positively charging property.

It is preferable that the electrophotographic toner of this invention further contains, as the coloring agent, a carbon black whose specific surface area based on BET (Braunauer-Emmerit-Teller) method is 110 to 250 $m^2/g$.

Specifically, the carbon black of not less than 110 $m^2/g$ has a small particle diameter and good coloring property. Therefore, by adding a small amount of the carbon black, the toner can be colored without decrease in image density.

Since the specific surface area of the carbon black is limited to not more than 250 $m^2/g$, it is avoidable to generate fog which is produced particularly at high-temperature and high-moisture. The fog is liable to generate by using a carbon black having a specific surface area exceeding 250 $m^2/g$, because such a carbon black shows poor dispersibility to the polyester resin.

It is also preferable that 0.1 to 2 parts by weight of fine powder of titanium oxide are added, as a surface treatment agent, to 100 parts by weight of the toner particles containing the polyester resin and the electric charge control resin.

To use the fine powder of the titanium oxide as the surface treatment agent ensures that the toner causes neither the increase of the conductive nor the decrease of the charging property, resulting in stable charging property and high positively charging property, as compared with fine powder of silica which has generally been used.

The contact development method of this invention, allowing to visualize an electrostatic latent image as a toner image by carrying out a negative-positive reversal from the exposed image, comprises contacting the electrophotographic toner, which is positively charged, with the electrostatic latent image which is formed by positively and uniformly charging and then exposing the surface of the positive charge type photoconductor, to transfer the toner onto the potential-decreased area, which is formed by exposure, in the electrostatic latent image by potential difference; and as the photoconductor and the electrophotographic toner, a single-layer positive charge type organic photoconductor and the electrophotographic toner of this invention being used, respectively.

Thus, in the above contact development method, the photoconductor having the single-layer positive charge type organic photosensitive layer requires no measures to prevent ozone from escaping outside because the amount of ozone produced at the charging is significantly small. This allows to simplify the device and to avoid the deterioration of the photoconductor. Further, the preparation of the single-layer positive charge type organic photosensitive layer is simpler than that of the conventional multi-layer type photoconductor, so that there are no defects and less variation in quality. Therefore, the combination of the above-mentioned organic photoconductor and the electrophotographic toner of this invention results in formation of the improved image.

DETAILED DESCRIPTION OF THE INVENTION

Figure 1:
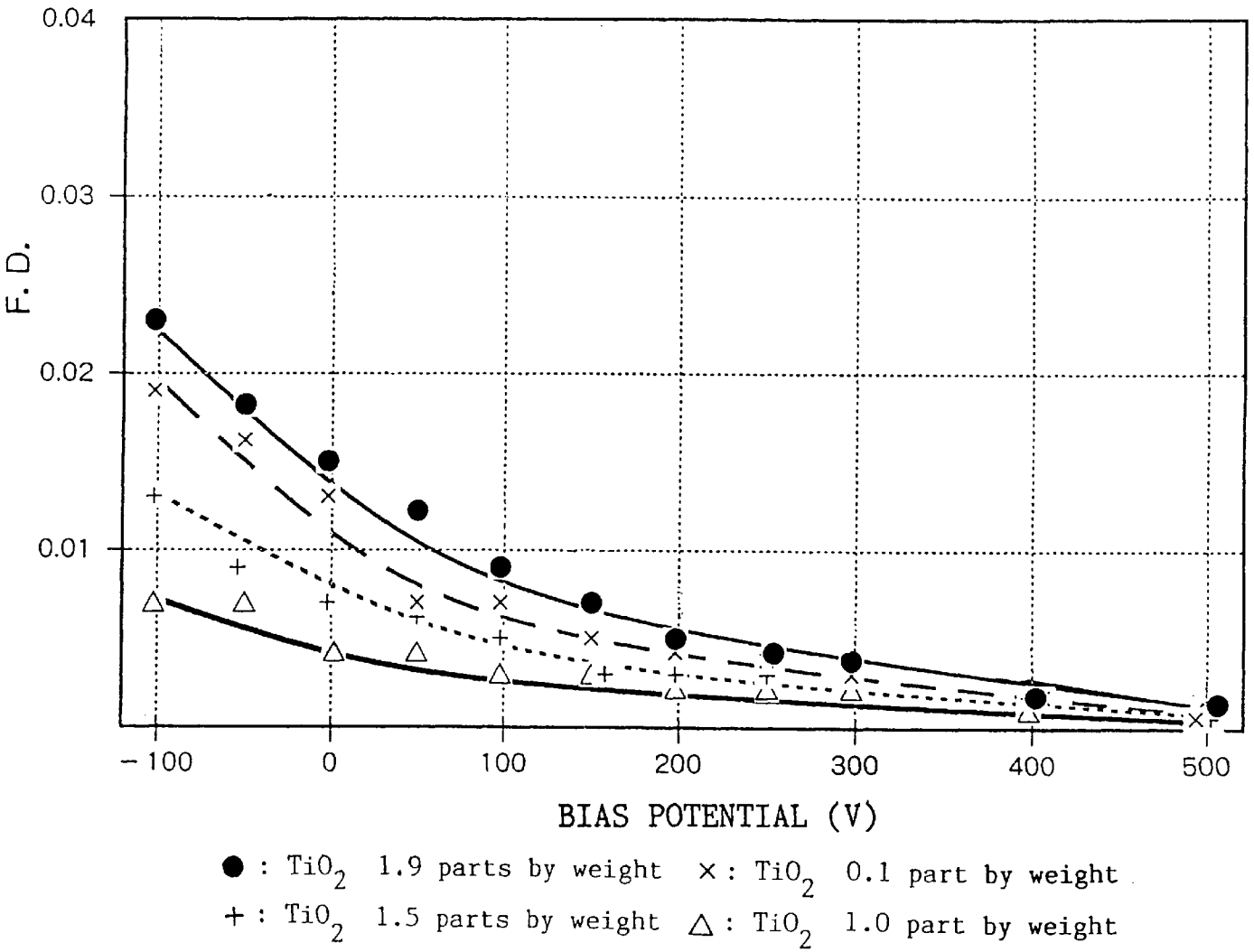
FIG. 1 is a graph showing the relation between the bias potential and the fog density in Examples of this invention.

The electrophotographic toner of this invention is prepared by dispersing at least the electric charge control agent, the coloring agent such as the carbon black and other additives, into the polyester resin being the fixing resin.

Examples of the polyester resin include a variety of saturated or unsaturated polyester resins, in which the main chain has an ester bonding. The preferred may be the following four kinds of polyester resins.

(i) a polyester resin obtainable by polycondensation of a carboxylic acid having divalent or more or ester thereof and a dihydric alcohol expressed by the general formula (1):

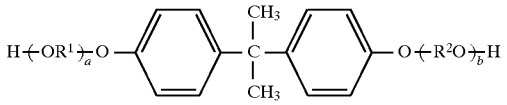

(1)

wherein $R^1$ and $R^2$ are the same or different, ethylene group or propylene group; and a and b are an integer of not less than 1;

(ii) a polyester resin obtainable by polycondensation of a dihydric alcohol, a dicarboxylic acid or ester thereof, and a compound expressed by the general formula (2):

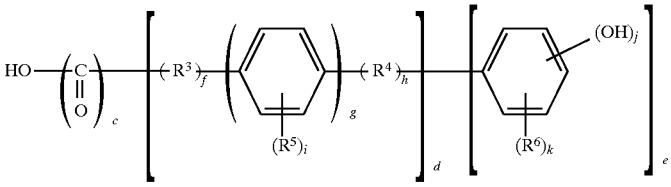

(2)

wherein $R^3$ is an alkylidene group having 1 to 6 carbon atoms or an alkylene oxide group having 1 to 3 carbon atoms; $R^4$ is an alkylidene group having 1 to 6 carbon atoms, oxygen atom, sulfur atom, carbonyl group, sulfinyl group or sulfonyl group; $R^5$ and $R^6$ are the same or different, hydrogen group, halogen atom or an alkyl group having 1 to 4 carbon atoms; c and d are 0 or 1, but are not 0 simultaneously; e is an integer of 1 to 3; f, g and h are the same or different, 0 or 1; i is an integer of 1 to 4; j is an integer of 0 to 4; and k is an integer of 1 to 4;

(iii) a polyester resin obtainable by allowing a dicarboxylic acid or ester thereof to react with a dihydric alcohol expressed by the general formula (3):

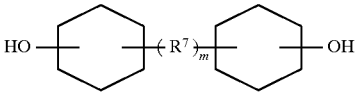

(3)

wherein $R^7$ is an alkylene group having 1 to 5 carbon atoms; and m is 0 or 1; and (iv) a polyester resin obtainable by allowing a dicarboxylic acid or ester thereof to react with a dihydric alcohol expressed by the general formula (4):

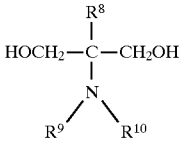

(4)

wherein $R^8$, $R^9$ and $R^{10}$ are the same or different, hydrogen atom or an alkyl group having 1 to 4 carbon atoms.

Examples of the dihydric alcohol of the general formula (1) include polyoxy-propylene(2,2)-2,2-bis(4-oxyphenyl) propane, polyoxypropylene(3,3)-2,2-bis(4-oxyphenyl) propane, polyoxyethylene(2,0)-2,2-bis(4-oxyphenyl) propane, polyoxypropylene(2)-polyoxyethylene(2)-2,2-bis (4-oxyphenyl)propane.

Examples of the compound of the general formula (2) include diphenol acid, o-oxybenzoic acid, m-oxybenzoic acid, p-oxybenzoic acid, 2,4-dioxybenzoic acid, o-oxyphenyl acetate, m-oxyphenyl acetate, p-oxyphenyl acetate, phenolphthalein, p-oxybenzyl alcohol, oxyethylene-p, p'-bisphenol, oxypropylene-bis(4-oxyphenyl)thioether, oxybutylene-bis(4-oxyphenyl)ketone.

Examples of the polyhydric alcohol used together with the compound of the general formula (2) include ethylene glycol, propylene glycol and glycerol.

Examples of the dihydric alcohol of the general formula (3) include 2,2-bis(4-oxycyclohexyl)propane, 2,2-bis(4-oxycyclohexyl)ether, 2,2-bis(4-oxycyclohexyl)ketone and 2,2-bis(4-oxycyclohexyl)sulfone.

Examples of the dicarboxylic acid or ester thereof to be reacted with the glycol or the like of the general formulae (1) to (4), include maleic acid, fumaric acid, mesaconic acid, citraconic acid, itaconic acid, glutaconic acid, phthalic acid, isophthalic acid, terephthalic acid, cyclohexanedicarboxylic acid, succinic acid, adipic acid, sebacic acid, malonic acid, linolenic acid; dimers of these acids; and lower alkyl esters of these acids (e.g., alkyl esters having 1 to 6 carbon atoms).

Examples of the carboxylic acid having trivalent or more to be reacted with the dihydric alcohol of the general formula (1), include 1,2,4-benzene tricarboxylic acid, 1,3,5-benzenetricarboxylic acid, 1,2,4-cyclohexanetricarboxylic acid, 1,3,5-cyclohexanetricarboxylic acid, 2,4,7-naphthalenetricarboxylic acid, 1,2,4-naphthalenetricarboxylic acid, 1,2,5-hexanetricarboxylic acid and 1,3-dicarboxy-2-methylcarboxypropene.

The above polyester resins have an acid value of not more than 10 mgKOH/g, and an hydroxyl value of not more than 40 mgKOH/g.

The acid value (AV) as defined in this invention means the amount of acidic component in the polyester, and expresses the amount of potassium hydroxide required for neutralizing the acidic component in 1 g of a sample, by unit "mg".

The hydroxyl value (OHV) as defined in this invention expresses, by unit "mg", the amount of potassium hydroxide required for neutralizing an acetic acid being bonded to an acetylated matter which is obtained from 1 g of a sample, and means the amount of hydroxide group in the polyester.

To obtain the OHV, the sample is heated with excess acetylating agent (e.g., acetic anhydride) to acetylate the polyester, and then a saponiication value of the acetylated matter is measured. The OHV is calculated from the following equation:

$$OHV = \frac{A}{1 - 0.00075A} - B$$

wherein A is the saponification value after the acetylation; and B is the saponification value before the acetylation.

When the acid value exceeds 10 mgKOH/g, it is liable that the electrophotographic toner cannot be positively charged at high efficiency, even though the electric charge control resin having positively charging property is added.

When the hydroxyl value exceeds 40 mgKOH/g, the moisture resistance of the electrophotographic toner may be lowered, so that the charging property tends to be unstable depending upon the temperature and the moisture in the environmental conditions.

Suitable acid value is 0.1 to 10 mgKOH/g, preferably 0.1 to 5 mgKOH/g, more preferably 0.1 to 1 mgKOH/g.

Suitable hydroxyl value is 0.1 to 40 mgKOH/g, preferably 0.1 to 20 mgKOH/g, more preferably 0.1 to 10 mgKOH/g.

To adjust the acid value and the hydroxyl value of the polyester resin within the above ranges, the acid group and the hydroxyl group in the polyester resin may be neutralized with a suitable substance. Specifically, to esterify the carboxyl group or the hydroxyl group which mainly exist at the ends of the polyester resin, a univalent alcohol may be reacted with the carboxyl group, and a univalent acid or a halide of the acid may be reacted with the hydroxyl group. Alternatively, the caroboxyl group or the hydroxyl group may be subjected to alkylation by the reaction such as epoxydation and amidation.

The glass transition temperature (Tg) of the polyester resin may be preferably 70° C. or more, in order to prevent the fusion due to heat generated by friction.

The molecular weight of the polyester resin is not specifically limited, however, in view of the strength of the toner and excellent fixing property to papers and the like, it is preferably about 1,000 to 500,000, more preferably about 10,000 to 100,000 of weight-average molecular weight.

The electric charge control resin added to the polyester resin is composed by introducing, as a side chain, a functional group that endows the positively charging property, to the main chain of a polymer.

A variety of the functional groups can be employed. Suitable example is a quaternary ammonium base groups expressed by the general formula (5):

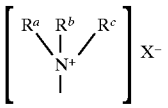

(5)

wherein $R^a$, $R^b$ and $R^c$ are the same or different, and denote a lower alkyl group having 1 to 6 carbon atoms, such as methyl group, ethyl group, n-propyl group, isopropyl group, n-butyl group, isobutyl group, tert-butyl group, pentyl group or hexyl group; X is halogen atom, $ClO_4$ group, $PF_4$ group or $BF_4$ group. The above ammonium base group is superior in endowing the positively charging property.

A variety of polymer chains can be employed as the main chain of the electric charge control resin. Suitable polymer chains are those having good compatibility with the polyester resin being the fixing resin, because the compatibility is a critical factor in view of the strength and the charging property of the toner.

The most suitable is the same main chain as the polyester resin. However, there is not known of the synthesis of any electric charge control resin in which the main chain is the polyester resin.

It is therefore appropriate to employ, as the main chain, styrene-acrylic resins such as styrene-acrylate copolymer and styrene-methacrylate copolymer, in view that they are readily synthesized and easy to purchase, and they have good compatibility with the polyester resin. When the main chain is the styrene-acrylic resin, it seems that a functional group may be substituted with an ester portion of the acryl.

In the electric charge control resin, the composition ratio (mol %) of the functional group is limited to 2 to 5 mol %. In the case that the electric charge control resin comprises a main chain obtainable by copolymerizing two kinds of monomers, and a functional group introduced to the main chain as a side chain to endow positively charging property to the toner, the composition ratio (mol %) of the functional group can be calculated from the following equation:

Proportion of the functional group (mol %) =

$$\frac{WC/MC}{WP_1/MP_1 + WP_2/MP_2 + WC/MC} \times 100$$

wherein $MP_1$ is the molecular weight of a first monomer composing the main chain;

$MP_2$ is the molecular weight of a second monomer;

MC is the molecular weight of the functional group being the side chain;

$WP_1$ is the proportion (weight ratio) of the first monomer in the electric charge control resin;

$WP_2$ is the proportion (weight ratio) of the second monomer in the electric charge control resin; and WC is the proportion (weight ratio) of the functional group in the electric charge control resin.

When the main chain of the electric charge control resin contains a third monomer, there may be added "$WP_3/MP_3$" ($WP_3$ is the proportion of the third monomer; and $MP_3$ is the molecular weight) to the denominator in the above equation. When using two kinds of functional groups being side chain, there may be added "WC'/MC'" (WC' is the proportion of the second functional group; and MC' is the molecular weight) to the denominator and the numerator, respectively.

When the proportion of the functional group in the electric charge control resin is less than 2 mol %, the function to endow the positively charging property to the toner is insufficient, and the positively charging property of the toner is lowered. In contrast, when a large amount of the electric charge control resin is added to prevent the decrease of the positively charging property, the mechanical and thermal strength of the toner may be decreased to cause spent toner or fusion between the toners. Because the resin, such as the styrene-acrylic resin, composing the main chain of the electric charge control resin has less strength than the polyester resin, and the molecular weight of the electric charge control resin is generally smaller than that of the polyester resin.

When the proportion of the functional group in the electric charge control resin exceeds 5 mol %, the functional group which inhibits the compatibility of the electric charge control resin to the polyester resin is increased, so that the above compatibility between the polyester resin and the electric charge control resin may be decreased.

As a result, since the structure of the particles of the toner is non-uniform, the mechanical and thermal strengths of the toner are decreased, so that in particular cracking and the like are likely to occur. Further, it is difficult to uniformly disperse the electric charge control resin into the toner particles, and therefore, the positively charging property is lowered.

As previously described, the proportion of the functional group in the electric charge control resin is 2 to 5 mol %, preferably 2 to 4 mol %, more preferably 3 to 4 mol %.

The proportion of the functional group in the electric charge control resin can be adjusted to the above ranges by adjusting the composition ratio (weight ratio) of the functional group.

The molecular weight of the electric charge control resin is preferably about 500 to 100,000, more preferably about 1,000 to 50,000, in weight-average molecular weight, but not particularly limited.

Suitable proportion of the electric charge control resin is not more than 20 parts by weight, preferably 1 to 20 parts by weight, for 100 parts by weight of the polyester resin, but is not particularly limited.

When the above proportion exceeds 20 parts by weight, it is liable that the mechanical and thermal strengths of the toner are decreased, causing the fusion between the toners, or spent toner. On the other hand, it is likely that the use of less than 1 part by weight of the electric control resin cannot sufficiently endow the positively charging property to the toner. Therefore, it is more preferred to use 5 to 15 parts by weight, particularly 7 to 12 parts by weight, for 100 parts by weight of the polyester resin.

As a coloring agent to color the toner, a variety of conventional dyes and pigments can be used.

In the case of black toner, carbon black can be mainly used as in the conventional toner. Examples of the carbon black include channel black, roller black, disk black, gas furnace black, oil furnace black, thermal black and acetylene black.

The refractive index of the polyester resin being the fixing resin is similar to that of glass, and the polyester resin is excellent in transparency. Thus in the toner for full color image-forming apparatuses using the three-color combination system comprising cyan (C), magenta (M) and yellow (Y) or the four-color combination system comprising cyan (C), magenta (M), yellow (Y) and black (K), the polyester resin can also be preferably used. In this occasion, it is necessary to add coloring agents for these colors.

The amount of the coloring agent is not particularly limited. When the carbon black is used, the carbon black which is conductive, functions to adjust the charging property and the electrical property of the toner particles. Accordingly, the amount of the carbon black may be varied to match a desired toner characteristics, and is normally not more than 10 parts by weight, particularly 1 to 9 parts by weight, more particularly 3.5 to 4.5 parts by weight, for 100 parts by weight of the polyester resin.

When the other coloring agent is used, the amount may be not more than 10 parts by weight, preferably 1 to 9 parts by weight, for 100 parts by weight of the polyester resin.

The carbon black used in this invention should have a specific surface area of 110 to 250 $m^2/g$, preferably 120 to 140 $m^2/g$.

When the specific surface area is less than 110 $m^2/g$, the coloring property is liable to be poor, resulting in insufficient image density. When a large amount of the carbon black is used in order to improve the image density, the fog may occur in a formed image because the resistance to potential is decreased, or the charging property is decreased particularly at high-temperature and high-moisture, as previously described.

When it is more than 250 $m^2/g$, the dispersibility to the polyester resin is liable to be poor, so that a chain-structure may be formed within the toner particles to decrease the charging property of the toner, causing the fog at particularly high-temperature and high-moisture. When the amount of the carbon black is decreased in order to prevent the fog, it is likely that sufficient image density cannot be obtained. As a result, there may be caused variations in the amount and the dispersed state of the carbon black in each toner particle, thereby producing a reversely charged toner being charged to the reverse polarity ("negatively" in this case), or non-charged toners.

The adjustment of the specific surface area of the carbon black within the above ranges may be carried out by adjusting the conditions related to the specific surface area of the carbon black, in the manufacturing processes of the carbon black.

In the case of the furnace black, the particles of the furnace black is obtained by mixing and burning a material oil, a burning oil and air in eddy air. At this stage, by setting a higher combustion temperature or a higher flow velocity, there can be obtained the furnace black having a smaller particle diameter and a larger specific surface area. Thus, the specific surface area of the furnace black can be adjusted by controlling the combustion temperature and the flow velocity.

As to other properties of the carbon black, no particular limitations are interposed, however, the pH value of the carbon black is preferably 2.5 to 5.0, more preferably 3.0 to 4.0. Over the pH 5.0, the dispersibility to the polyester resin is liable to be poor, so that the carbon black may form a chain structure in the toner particle to decrease the charging property of the toner, causing fog at particularly high-temperature and high- moisture.

The carbon black normally shows alkaline because magnesium and sodium are incorporated into the carbon black in the manufacturing processes thereof. Therefore, to adjust the pH of the carbon black within the above range, it is preferred that the prepared carbon black is subjected to oxidation in a liquid phase or gas-phase, so that the prepared carbon black is provided with an acid functional group.

To the electrophotographic toner of this invention, a variety of the conventional additives such as lubricant (anti-offset agent) may be added in addition to the aforesaid ingredients.

Examples of the lubricant include aliphatic hydrocarbons, fatty acid metallic salts, higher fatty acids, fatty acid esters or partially saponified compounds thereof, silicone oil and a variety of waxes. Most preferred is the aliphatic hydrocarbon having an average-molecular weight of about 1,000 to about 10,000, such as polypropylene having lower molecular weight, polyethylene of lower molecular weight, paraffin wax and olefin polymer of lower molecular weight which comprises an olefin unit having 4 or more carbon atoms. These can be used alone or in any combination thereof.

The lubricant may be used in 0.1 to 10 parts by weight, preferably 0.5 to 8 parts by weight, for 100 parts by weight of the polyester resin.

The electrophotographic toner of this invention can be produced by:

uniformly melting and kneading a mixture obtained by uniformly premixing the aforesaid ingredients with a dry-blender, Henschel mixer or ball mill, using a kneading apparatus such as Banbury mixer, open roll, or single- or twin-screw extruder; and cooling the resulting kneaded mixture, followed by pulverizing and optional classifying. The toner may be produced by suspension polymerization or spraying drying.

It is preferred that the particle size of the toner particle is not more than 10 $\mu$m, but this invention is applicable to a toner having the particle size exceeding 10 $\mu$m, in order to improve the image quality of the image formed. In the electrophotographic toner for attaining high image-quality, the particle size is preferably 5 to 9 $\mu$m. In the normal electrophotographic toners, the particle size is preferably 9 to 11 $\mu$m.

In order to improve the fluidity and the charging property of the obtained toner particle, a surface treating agent may be added to the toner particle and mixed in the same manner as in the aforesaid premixing, so that the surface treating agent is uniformly adhered to the surface of the toner particle.

A variety of the conventional surface treating agent can be used, for example, inorganic fine particles and fluororesin fine particles. Preferred is silica surface treating agents containing hydrophobic or hydrophilic silica fine particles (e.g., silica anhydride in ultrafine particle, colloidal silica). They are preferably used in 0.1 to 3 parts by weight for 100 parts by weight of the toner particles.

In this invention, in order to obtain stable charging property and superior positively charging property while avoiding the increase of the conductive and the inferior charging property, it is preferred that the fine powder of titanium oxide is used as the surface treating agent, the titanium oxide powder may be used alone or jointly used with any conventional surface treating agent.

The mean particle diameter of the fine powder of the titanium oxide may be 10 nm to 300 nm, preferably 30 nm to 100 nm. Under 10 nm, the effect of the titanium oxide might be insufficient. Over 300 nm, the flowability might deteriorate.

The powder of the titanium oxide may be used in 0.1 to 2 parts by weight, preferably 0.2 to 1 part by weight, for 100 parts by weight of the polyester resin. Under 0.1 part by weight, the effect of the titanium oxide tends to be insufficient. Over 2 parts by weight, since the surface of the toner is completely covered with the titanium oxide, the charging property is lowered to cause fog. Moreover, a drum might be flawed, or the toner might be fused on the surface of the drum.

This invention is applicable to toners for other development methods such as the non-magnetic one-component non-contact development, the normal two-component magnetic brush development and the magnetic one-component development, although the toners for the non-magnetic one component contact development is most suitable.

In the two-component magnetic brush development, the toner of this invention is combined with any conventional magnetic carriers. In the magnetic one-component development, any conventional magnetic materials may be added to the polyester resin being the fixing resin.

The contact development method of this invention is the non-magnetic one-component contact development employing the reversal development technique, which comprises a combination of the electrophotographic toner of this invention and the photoconductor having the single-layer positive charge type organic photosensitive layer.

Figure 3:
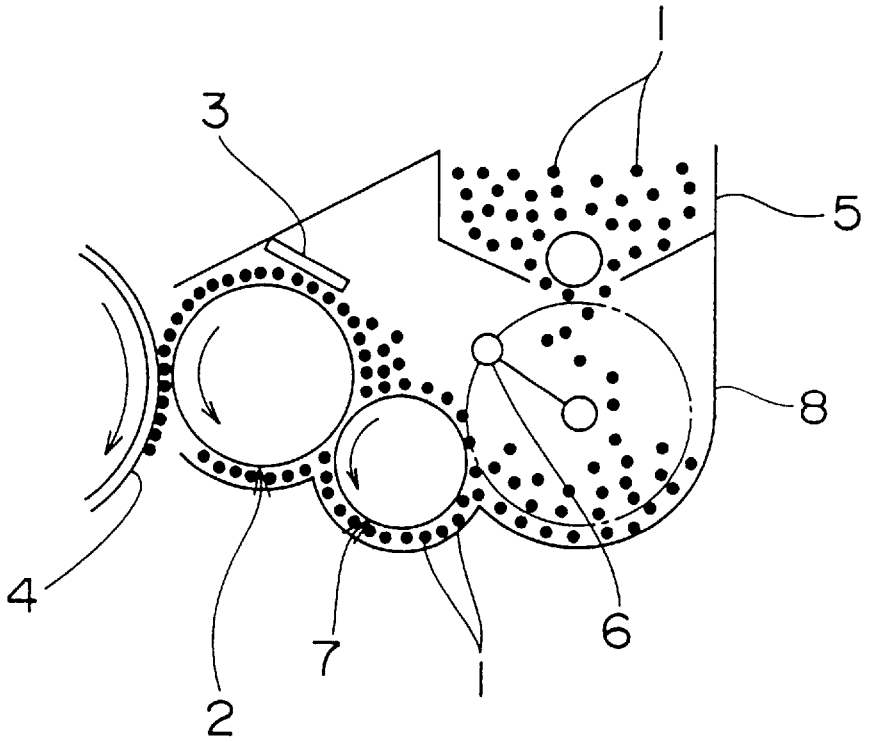
FIG. 3 is a schematic diagram showing the non-magnetic one-component contact development of this invention.

The above development method is, for example, applied to the device shown in FIG. 3. Specifically, the electrophotographic toner 1 of this invention is positively charged by the friction between the development sleeve and the regulating blade 3 which are provided in the development device 8, and is adhered to the surface of the development sleeve 2 with the image force, to form a uniformly thin film of the positively charged toner 1 on the development sleeve 2.

By corona discharge, the surface of the photoconductor 4 is uniformly charged to the same polarity as the toner 1 and is then exposed by a laser beam or the like to form an electrostatic latent image. In the electrostatic latent image, the potential of an exposed area is lower and that of an unexposed area is higher, than a developing bias potential.

When the thin layer on the surface of the development sleeve is contacted with the electrostatic latent image on the surface of the photoconductor 4, in the unexposed area, the toner 1 is not transferred to the photoconductor 4 since the potential of the photoconductor 4 is higher than the developing bias potential. In the exposed area, since the potential of the photoconductor 4 is lower than the developing bias potential, the toner 1 is transferred to the surface of the photoconductor 4 from the thin layer by the potential difference. Thus there is formed, on the surface of the photoconductor 4, an image of the toner 1 wherein the negative and positive charges have been reversed.

The photoconductor used in the above development method is prepared by forming the single-layer positive charge type organic photosensitive layer on the surface of a conducting substrate. The single-layer positive charge type organic photosensitive layer is prepared by including an electric charge generating agent and an electric charge transferring agent into a layer comprising a binding resin.

Examples of the binding resin include conventional synthetic resins, such as styrene polymer, acrylic polymer, styrene-acrylic copolymer, ethylene-vinyl acetate copolymer, olefin polymer (e.g. polypropylene, ionomer), polyvinyl chloride, vinyl chloride-vinyl acetate copolymer, polyester, alkyd resin, polyamide, polyurethane, epoxy resin, polycarbonate, polyalylate, polysulfon, diaryl phthalate resin, silicone resin, ketone resin, polyvinyl butyral, polyether, phenol resin, photosetting resin (e.g. epoxy acrylate). These binding resins can be used alone or in combination thereof.

Preferred are styrene polymer, acrylic polymer, styrene-acrylic copolymer, polyester, alkyd resin, polycarbonate, polyacrylate and the like. The most preferred is a so-called bisphenol type polycarbonates which can be synthesized from a phosgene and bisphenols represented by the formula (6):

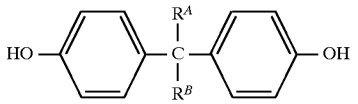

(6)

wherein $R^A$ and $R^B$ are the same or different, hydrogen atom or lower alkyl group, such as methyl group and ethyl group; and $R^A$ and $R^B$ may bond with each other to form a cyclic ring such as cyclohexane ring, together with a carbon atom of the main chain.

Examples of the electric charge generating material to be contained in the layer comprising the binding resin, include selenium, selenium-tellurium, amorphous-silicon, pyrylium salt, azo pigments, disazo pigments, anthanthrone pigments, phthalocyanine pigments, indigo pigments, therene pigments, toluidine pigments, pyrazoline pigments, perylene pigments, quinacridon pigments and the like. These may be used alone or in any combination thereof such that they have a sensitivity within a desired absorption wavelength.

The most preferred are phthalocyanine pigments (e.g. the X-type metal-free phthalocyanine, oxotitanylphthalocyanine) and perylene pigments represented by the formula (7):

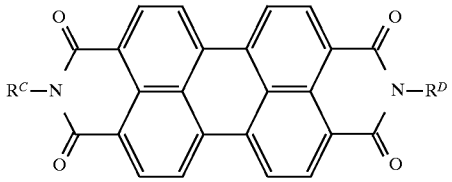

(7)

wherein $R^C$ and $R^D$ are the same or different, alkyl group, cycloalkyl group, aryl group or aralkyl group having carbon atoms of not more than 18, and each may have a substituent.

Examples of the alkyl group include alkyl groups having 1 to 8 carbon atoms, such as methyl group, ethyl group, n-propyl group, iso-propyl group, n-butyl group, iso-butyl group, sec-butyl group, tert-butyl group and 2-ethylhexyl group.

Examples of the cycloalkyl group include cyclohexyl group.

Examples of the aryl group include phenyl group, napthyl group, tolyl group, xylyl group and ethylphenyl group.

Examples of the aralkyl group include benzyl group and phenethyl group.

Examples of the substituent which may be substituted with the above-listed groups include lower alkyl group such as methyl group, ethyl group; alkoxy group such as methoxy group, ethoxy group; and halogen atom such as chlorine, iodine and bromine.

As the electric charge transferring material, there are electron transferring material excellent in electric transferring property and hole transferring material excellent in hole transferring property.

Examples of the electron transferring material include electron attractive material such as para-diphenoquinone derivative, benzoquinone derivative, naphthoquinone derivative, trinitrofluorenoneimine derivative, tetracyanoethylene, tetracyanoquinodimethane, chloroanil, bromoanil, 2,4,7-trinitro-9-fluorenone, 2,4,5,7-tetranitro-9-fluorenone, 2,4,7-trinitro-9-dicyanomthylenefluorenone, 2,4,5,7-tetranitroxanthone and 2,4,8-trinitrothioxanthone; and high-molecular electron attractive materials.

Preferred is para-diphenoquinone derivative represented by the formula (8):

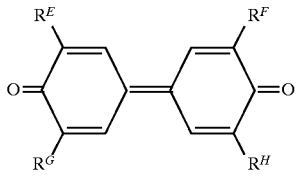

(8)

wherein $R^E$, $R^F$, $R^G$ and $R^H$ are the same or different, a hydrogen atom, an alkyl group, a cycloalkyl group, an aryl group, an aralkyl group or an alkoxy group.

The most preferred is unsymmetrical para-diphenoquinone derivative such as para-diphenoquinone derivatives wherein two substituents out of the substituents $R^E$, $R^F$, $R^G$ and $R^H$ are lower straight-chain alkyl groups and the others are a branched alkyl, cycloalkyl, aryl or aralkyl group, in view of excellent electron transferring property and solubility to the binding resin.

Examples of the alkyl group include the respective groups as described above.

Examples of the hole transferring material include the following compounds:

pyrene, N-ethylcarbazole, N-isopropylcarbazole, N-methyl-N-phenylhydrazino-3-methylidine-9-carbazole, N,N-diphenylhydrazino-3-methylidene-9-ethylcarbazole, N,N-diphenylhydrazino-3-methylidene-10-ethylphenothiazine N,N-diphenylhydrazino-3-methylidene-10-ethylphenoxazine;

hydrazone salt such as p-diethylaminobenzaldehyde-N,N-diphenylhydrazone, p-diethylaminobenzaldehyde-α-naphthyl-N-phenylhydrazone, p-pyrrolidinobenzaldehyde-N,N-diphenylhydrazone, 1,3,3-trimethylindolenine-ω-aldehyde-N,N-diphenylhydrazone, p-diethylbenzaldehyde-3-methylbenzazolinone-2-hydrazone;

2,5-bis(p-diethylaminophenyl)-1,3,4-oxadiazole;

pyrazoline such as 1-phenyl-3-(p-diethylaminostyryl)-5-(p-diethylaminophenyl)pyrazoline, 1-[quinonyl(2)]-3-(p-diethylaminostyryl)-5-(p-diethylaminophenyl)pyrazoline, 1-[pyridyl(2)]-3-(p-diethylaminostyryl)-5-(p-diethylaminophenyl)pyrazoline, 1-[6-methoxypyridyl(2)]-3-(p-diethylaminostyryl)-5-(p-diethylaminophenyl)pyrazoline, 1-[pyridyl(3)]-3-(p-diethylaminostyryl)-5-(p-diethylaminophenyl)pyrazoline, 1-[lepidyl(3)-3-(p-diethylaminosytryl)-5-(p-diethylaminophenyl)pyrazoline, 1-[pyridyl(2)]-3-(p-diethylaminosytryl)-4-methyl-5-(p-diethylaminophenyl)pyrazoline, 1-[pyridyl(2)]-3-(α-methyl-p-diethylaminostyryl)-3-(p-diethylaminophenyl)pyrazoline, 1-phenyl-3-(p-diethylaminostyryl)-4-methyl-5-(p-diethylaminophenyl)pyrazoline;

oxazole such as 2-(p-diethylaminostyryl)-3-diethylaminobenzole, 2-(p-diethylaminophenyl)-4-(p-diethylaminophenyl)-5-(2-chlorophenyl)oxazole;

thiazole such as 2-(p-diethylamino-styryl)-6-diethylaminobenzothiazole;

triarylmethane compound such as bis(4-diethylamino-2-methylphenyl)phenylmethane;

polyarylalkane such as 1,1-bis(4-N,N-diethylamino-2-methylphenyl)heptane, 1,1,2,2-tetrakis(4-N,N-diethylamino-2-methylphenyl)ethane;

benzidine compound such as N,N'-diphenyl-N,N'-bis(methylphenyl)benzidine, N,N'-diphenyl-N,N'-bis(ethylphenyl)benzidine, N,N'-diphenyl-N,N'bis(propylphenyl)benzidine, N,N'-diphenyl-N,N'bis(butylphenyl)benzidine, N,N'-bis(isopropylphenyl)benzidine, N,N'-diphenyl-N,N'-bis(sec-butylphenyl)benzidine, N,N'-diphenyl-N,N'-bis(tert-butylphenyl)benzidine, N,N'-diphenyl-N,N'-bis(2,4-dimethylphenyl)benzidine, N,N'-diphenyl-N,N'-bis(chlorophenyl)benzidine;

triphenylamine, poly-N-vinylcarbazole, polyvinylpyrene, polyvinylanthracene, polyvinylacridine, poly-9-vinylphenylanthracene, pyrene-formaldehyde resin and ethylcarbazole formaldehyde resin.

The most preferred examples of the hole transferring material are:

the benzidine compound represented by the formula (9):

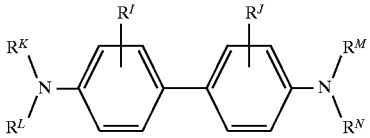

(9)

wherein $R^I$ and $R^J$ are the same or different, a lower alkyl group such as methyl group, ethyl group; and $R^K$, $R^L$, $R^M$ and $R^N$ are the same or different, an alkyl group having carbon atoms 1 to 18, cycloalkyl group, aryl group or aralkyl group; and the carbazolehydrazone compound out of the hydrazone salts, which are represented by the formula (10):

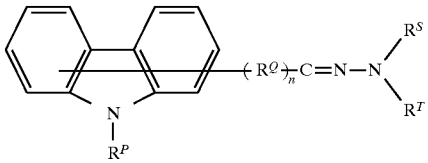

(10)

wherein $R^P$ is a hydrogen atom, an alkyl group or an acyl group; $R^Q$ is a divalent organic group such as alkylene group; $R^R$ and $R^T$ are the same or different, an alkyl having 1 to 18 carbon atoms, cycloalkyl, aryl group or aralkyl group; and n is an integer of 1 to 3, in view of excellent hole transferring property and solubility to the binding resin.

Examples of the alkyl group include the respective groups as described above.

Examples of the acyl group include formyl group, acetyl group, propionyl group, butyryl group and valeryl group.

Examples of the alkylene group include ethylene group, propylene group and butylene group.

The amount of the electric charge generating material is not specifically limited, but may be about 0.1 to 5% by weight, preferably about 0.25 to 2.5% by weight, based on the total amount (total amount of a solid content) of the respective ingredients constituting the single-layer type positive charging organic photosensitive layer.

The amount of the electron transferring material may be about 5 to 50% by weight, preferably about 10 to 40% by weight, based on the total amount of the solid content.

The amount of the hole transferring material may be about 5 to 50% by weight, preferably about 10 to 40% by weight, based on the total amount of the solid content. It is preferred that the electron transferring material and the hole transferring material are present in 1:9 to 9:1, particularly 2:8 to 8:2, in weight ratio.

The single-layer positive charge type organic photosensitive layer can be prepared by the following manner.

The above respective ingredients are dispersed and mixed with a suitable solvent using a roll mill, a ball mill, an atriter, a paint shaker or a supersonic dispenser to prepare a coating solution for photosensitive layer, which is applied on the surface of a conductive substrate by dip coating, bar coating, spray coating, flow coating or spin coating, followed by drying.

The solid content of the coating solution can be suitably adjusted depending upon the coating method as described, and normally, 5 to 50% by weight is preferred.

In addition to the aforesaid ingredients, a variety of additives can be added to a coating solution to a degree that no affects are exerted on the properties of the photoconductor. Examples of the additives include antioxidant, radical scavenger, singlet quencher, ultraviolet absorber, softener, surface modifier, antifoamer, bulking agent, thickener, dispersion stabilizer, wax, acceptor and donor.

When a steric hindering phenolic antioxidant is added in an amount of about 0.1 to 50% by weight based on the total amount of the solid content, the durability of the photosensitive layer can be improved without any affects on the properties of the photoconductor.

There can be used a variety of conducting substrates (e.g., drum type, plate type and sheet type) which are prepared from different conducting materials and fit to the structures of image-forming apparatuses.

Examples of the material for the conducting substrate include metals and alloys, such as alumtin, copper, tin, platinum, gold, silver, vanadium, molybdenum, chromium, cadmium, titanium, nickel, indium, stainless steel, brass; a plastic material wherein the above metal is vapor-deposited or laminated on the surface; glass materials coated with aluminum iodide, tin oxide, indium oxide. The most preferred is aluminum, particularly an anodized aluminum having an anodized thickness of 1 to 50 $\mu$m, in order not to cause interference fringe.

As the solvent used in preparing the coating solution, there can be used various organic solvents. There are, for example, alcohols such as methanol, ethanol, isopropanol, butanol; aliphatic hydrocarbons such as n-hexane, octane, cyclohexane; aromatic hydrocarbons such as benzene, toluene, xylene; halogenated hydrocarbons such as dichloromethane, dichloroethane, carbon tetrachloride, chlorobenzene; ethers such as dimethyl ether, diethyl ether, tetrahydrofuran, ethylene glycol dimethyl ether, diethylene glycol dimethyl ether; ketones such as acetone, methyl ethyl ketone, cyclohexanone; esters such as ethyl acetate, methyl acetate; dimethylformaldehyde; and dimethylsulfoxide. These can be used alone or in any combination thereof, depending upon the solubility of the aforesaid ingredients.

As mentioned above, accordingly to this invention, there is provided the electrophotographic toner which can exhibit stable positively charging property by using the sturdy polyester resin as the fixing resin, and enables to form the excellent image having fine image-quality, without fog nor the decrease of image density.

The excellent image having more improved image-quality is obtainable by combining the above toner with the photoconductor having the single-layer positive charge type organic photosensitive layer.

EXAMPLES

The invention will be further illustrated by the following examples and comparative examples.

Example 1

The following ingredients of each given amount was mixed, melted, kneaded, pulverized and classified to prepare a toner particle having the mean particle diameter of 8 $\mu$m.

Ingredients (a) Fixing resin: a polyester resin of the type (i) as described, whose acid value (AV) is 3.1 mgKOH/g, and hydroxyl value (OHV) is 35 mgKOH/g;

(b) Electric charge control resin comprising the copolymer of styrene and buthylacrylate as the main chain, and the trialkylammonio group of the general formula (5) as the functional group (the molecular weight: 372, the proportion in the electric charge control resin: 2.3 mol %);

(c) Coloring agent: carbon black (the specific surface area according to BET method: 110 $m^2$/g, the particle diameter: 29 nm, the pH: 4.0, the DBP oil absorption: 150 ml/100 g; and volatile component: 10%); and (d) Lubricant agent: polypropylene wax Proportion of the Ingredients

| (Ingredients) | (parts by weight) |
|---|---|
| Fixing resin | 100 |
| Electric charge control resin | 16 |
| Coloring agent | 4 |
| Lubricant | 2.5 |

As the surface treating agent, 0.5 part by weight of hydrophobic silica was added to 100 parts by weight of the prepared toner particles, to give a positive charge type electrophotographic toner.

Example 2

A positive charge type electrophotographic toner was prepared in the same manner as in EXAMPLE 1, except for the use of 12 parts by weight of the electric charge control resin in which the proportion of the functional group was 3.0 mol %.

Example 3

A positive charge type electrophotographic toner was prepared in the same manner as in EXAMPLE 1, except for the use of 10 parts by weight of the electric charge control resin in which the proportion of the functional group was 3.6 mol %.

Example 4

A positive charge type electrophotographic toner was prepared in the same manner as in EXAMPLE 1, except for the use of 7.5 parts by weight of the electric charge control resin in which the proportion of the functional group was 4.8 mol %.

Comparative Example 1

A positive charge type electrophotographic toner was prepared in the same manner as in EXAMPLE 1, except for the use of 7.5 parts by weight of the electric charge control resin in which the proportion of the functional group was 15 mol %.

Example 5

A positive charge type electrophotographic toner was prepared in the same manner as in EXAMPLE 2, except that 100 parts by weight of the polyester resin (AV: 5.9 mgKOH/g; and OHV: 37.5 mgKOH/g) was used as the fixing resin.

Comparative Example 2

A positive charge type electrophotographic toner was prepared in the same manner as in EXAMPLE 2, except that 100 parts by weight of the polyester resin (AV: 21.5 mgKOH/g; and OHV: 42.5 mgKOH/g) was used as the fixing resin.

Evaluation Test

In order to evaluate the characteristics of the prepared electrophotographic toners, a black and white image was respectively formed by a test device, which was prepared by modifying a commercially available laser printer (Model LDC650, available from Mita Industrial Co. Ltd.) to a printer used in the non-magnetic one-component contact reverse development employing a positive charge type photoconductor drum.

Production of the photoconductor drum used in the test

The following ingredients of each given amount were mixed and dispersed with a paint shaker to prepare a coating solution. The coating solution is applied on an aluminum tube by dip coating method, followed by hot-air drying in a dark place at 60° C. for 60 minutes, to give a positive charge type photoconductor drum having a single-layer type positive charging organic photosensitive layer (15 $\mu$m in thickness).

| (Ingredients) | (parts by weight) |
|---|---|
| Metal-free phthalocyanine (electric charge generating material) | 5 |
| N,N'-diphenyl-N,N'-bis(2,4-dimethylphenyl)benzidine (hole transferring material) | 40 |
| 3,3',5,5'-tetraphenyldiphenoquinone (electron transferring material) | 40 |
| Polycarbonate (binding resin) | 100 |
| Dichloromethane | 800 |

The image density (hereinafter referred to as "I.D.") of the image area and the fog density (hereinafter referred to as "F.D.") of the blank area in the black and white image formed by said test device were determined by a reflection densitometer (Model TC-6D, available from Tokyo Denshoku Co., Ltd.).

Table 1 shows the results. It is noted that as the value of the I.D. increases and the value of the F.D. approaches "0", the image is improved.

TABLE 1

| | Polyester resin | | Electric charge control resin | | | |
|---|---|---|---|---|---|---|
| | AV | OHV | Functional group(mol %) | parts by weight | I.D. | F.D. |
| Ex. 1 | 3.1 | 35 | 2.3 | 16 | 1.30 | 0.004 |
| Ex. 2 | 3.1 | 35 | 3.0 | 12 | 1.39 | 0.004 |
| Ex. 3 | 3.1 | 35 | 3.6 | 10 | 1.39 | 0.004 |
| Ex. 4 | 3.1 | 35 | 4.8 | 7.5 | 1.40 | 0.005 |
| Comp. Ex. 1 | 3.1 | 35 | 15 | 7.5 | 1.40 | 0.084 |
| Ex. 5 | 5.9 | 37.5 | 3.0 | 12 | 1.42 | 0.005 |
| Comp. Ex. 2 | 21.5 | 42.5 | 3.0 | 12 | 1.25 | 0.150 |

Example 6

A positive charge type electrophotographic toner was prepared in the same manner as in EXAMPLE 1, except for the use of 4 parts by weight of the carbon black (the specific surface area according to the BET method: 134 $m^2/g$, the particle diameter: 22 nm, the pH value: 3.5, the DBP oil absorption: 100 ml/100 g, and the volatility: 1.5%).

Example 7

A positive charge type electrophotographic toner was prepared in the same manner as in EXAMPLE 1, except for the use of 4 parts by weight of the carbon black (the specific surface area according to the BET method: 220 $m^2/g$, the particle diameter: 16 nm, the pH value: 9.0, the DBP oil absorption: 100 ml/100 g, and the volatile component: 1.2%).

Example 8

A positive charge type electrophotographic toner was prepared in the same manner as in EXAMPLE 1, except for the use of 4 parts by weight of the carbon black (the specific surface area according to the BET method: 90 $m^2/g$, the particle diameter: 29 nm, the pH value: 4.5, the DBP oil absorption: 115 ml/100 g, and the volatile component: 5%).

Example 9

A positive charge type electrophotographic toner was prepared in the same manner as in EXAMPLE 1, except for the use of 4 parts by weight of the carbon black (the specific surface area according to the BET method: 300 $m^2/g$, the particle diameter: 14 nm, the pH value: 9.0, the DBP oil absorption: 95 ml/100 g, and the volatile component: 1%).

Using each of the obtained toners of EXAMPLES 6 to 9, a black and white image was formed by the same test device at normal temperature of 25° C. and normal moisture of 65% RH (hereinafter referred to as "N/N condition"), and high temperature of 35° C. and high moisture of 85% RH (hereinafter referred to as "H/H condition"). Then, the image density (I.D.) of the image area and the fog density (F.D.) of the blank area in the image formed were determined in the same manner as described above. Table 2 shows the results.

TABLE 2

| | N/N condition | | H/H condition | |
|---|---|---|---|---|
| | I.D. | F.D. | I.D. | F.D. |
| Example 6 | 1.405 | 0.000 | 1.402 | 0.002 |
| Example 7 | 1.411 | 0.001 | 1.403 | 0.004 |
| Example 8 | 1.342 | 0.000 | 1.320 | 0.001 |
| Example 9 | 1.410 | 0.001 | 1.381 | 0.011 |

Example 10

A toner particle having the mean particle diameter of 8 $\mu$m was prepared in the same manner as in EXAMPLE 1, except that there are used the polyester resin of the aforesaid type (i) (AV: 2.5 mgKOH/g, OHV: 6.5 mgKOH/g) as the fixing resin; and 12 parts by weight of the electric charge control resin, in which the main chain comprises the copolymer of styrene and buthylaclylate, and the function group comprising the trialkylammonio group (the molecular weight: 372) of the general formula (5), is present in 3 mol %.

To 100 parts by weight of the obtained toner particle, 0.5 part by weight of the hydrophobic silica and 0.1 part by weight of the fine particles of titanium oxide having the mean particle diameter of 100 nm were added to prepare a positive charge type electrophotographic toner.

Examples 11 to 13

A positive charge type electrophotographic toners were prepared in the same manner as in EXAMPLE 10, except that each proportion of the titanium oxide to be added to 100 parts by weight of the toner particle was altered as shown in Table 3.

TABLE 3

| | Amount of titanium oxide (parts by weight) |
|---|---|
| Example 11 | 1.0 |
| Example 12 | 1.5 |
| Example 13 | 1.9 |

In order to evaluate the characteristics of the toners prepared in EXAMPLEs 10 to 13, a black and white image was respectively formed by the aforesaid test device, and the fog density (F.D.) of the blank area in the image formed was determined in the same manner as described above.

FIG. 1 and Table 4 show the relation between the bias potential and the F.D.

TABLE 4

| Bias potential | Amount of titanium oxide (parts by weight) | | | |
|---|---|---|---|---|
| (V) | 0.1 | 1.0 | 1.5 | 1.9 |
| −100 | 0.019 | 0.007 | 0.013 | 0.023 |
| −50 | 0.016 | 0.007 | 0.009 | 0.018 |
| 0 | 0.013 | 0.004 | 0.007 | 0.016 |
| 50 | 0.007 | 0.004 | 0.006 | 0.012 |
| 100 | 0.007 | 0.003 | 0.005 | 0.009 |
| 150 | 0.005 | 0.003 | 0.003 | 0.007 |
| 200 | 0.003 | 0.002 | 0.603 | 0.005 |
| 250 | 0.003 | 0.002 | 0.003 | 0.004 |

TABLE 4-continued

| Bias potential | Amount of titanium oxide (parts by weight) | | | |
|---|---|---|---|---|
| (V) | 0.1 | 1.0 | 1.5 | 1.9 |
| 300 | 0.003 | 0.002 | 0.003 | 0.004 |
| 400 | 0.002 | 0.001 | 0.002 | 0.002 |
| 500 | 0.001 | 0.001 | 0.001 | 0.002 |

Using each of the toners of EXAMPLES 10 to 13, a black and white image was formed in the temperature of 35° C. and the moisture of 85% RH.

The F.D. values were relatively increased than those in Table 4, but were within the level in which no disadvantages might be caused in the practical bias potential.

Comparative Examples 3 to 6

A positive charge type electrophotographic toners were prepared in the same manner as in EXAMPLE 1, except for the uses of the polyester resin having the acid value of 12 mgKOH/g, and the titanium oxide (the mean particle diameter: 100 nm) as shown in Table 5.

TABLE 5

| | Amount of titanium oxide (parts by weight) |
|---|---|
| Comp. Ex. 3 | 0 |
| Comp. Ex. 4 | 0.5 |
| Comp. Ex. 5 | 1.0 |
| Comp. Ex. 6 | 1.5 |

The F.D. of Comparative Examples 3 to 6 were determined in the same manner as described above.

Figure 2:
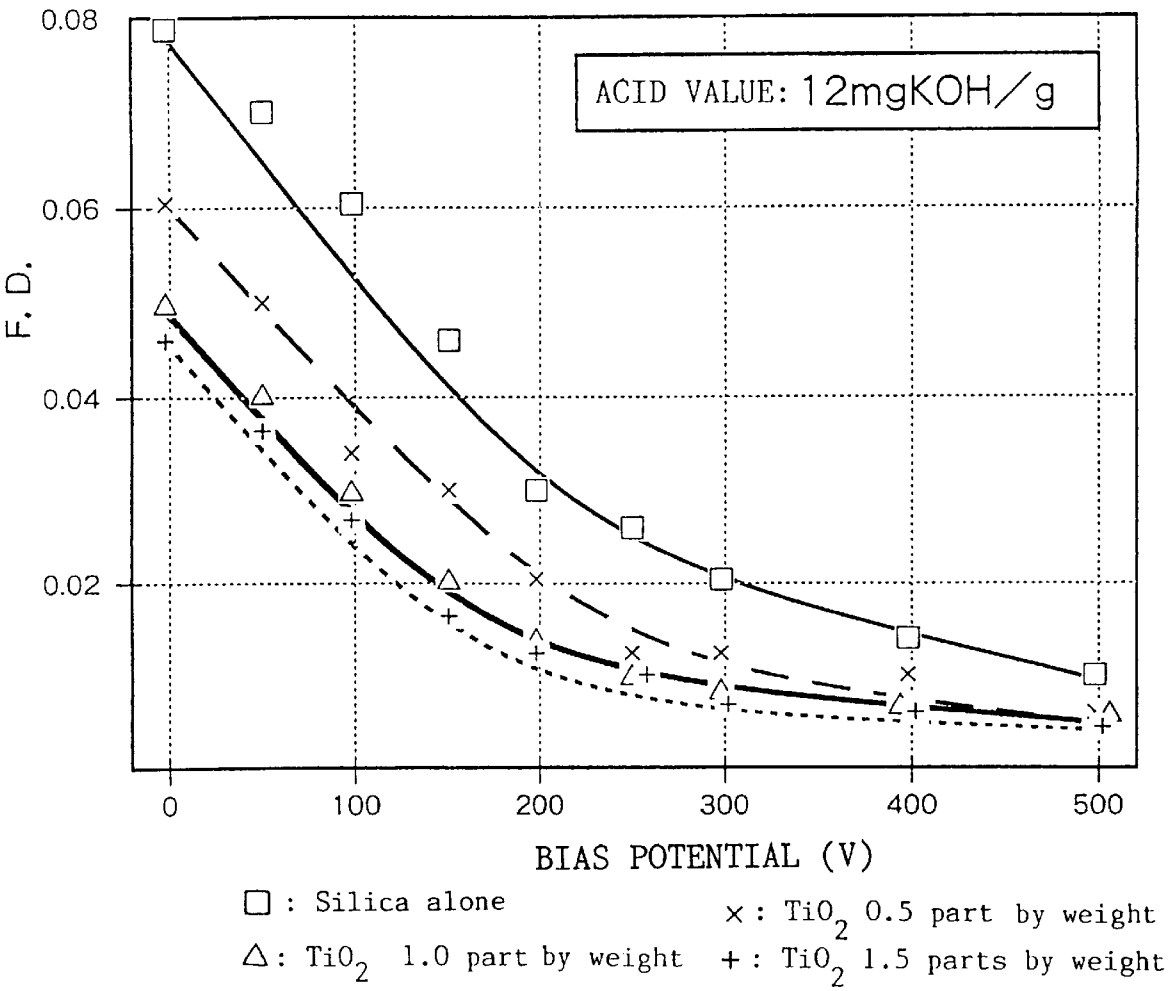
FIG. 2 is a-graph showing the relation between the bias potential and the fog density in Comparative Examples of this invention.

FIG. 2 and Table 6 show the results.

TABLE 6

| Bias potential | Amount of titanium oxide (parts by weight) | | | |
|---|---|---|---|---|
| (V) | 0 | 0.5 | 1.0 | 1.5 |
| 0 | 0.080 | 0.060 | 0.050 | 0.045 |
| 50 | 0.070 | 0.050 | 0.040 | 0.037 |
| 100 | 0.060 | 0.035 | 0.030 | 0.027 |
| 150 | 0.045 | 0.030 | 0.020 | 0.015 |
| 200 | 0.030 | 0.020 | 0.014 | 0.012 |
| 250 | 0.025 | 0.012 | 0.010 | 0.010 |
| 300 | 0.020 | 0.012 | 0.009 | 0.008 |
| 400 | 0.015 | 0.010 | 0.007 | 0.007 |
| 500 | 0.010 | 0.005 | 0.005 | 0.005 |

Using each of the toners of Comparative Examples 3 to 6, a black and white image was formed in the temperature of 35° C. and the moisture of 85% RH. As a result, there were observed fogs over the whole area of the bias potential.

What is claimed is:

1. An electrophotographic toner comprising a polyester resin as a fixing resin, a resin having a functional group that endows a positively charging property to the toner, and a coloring agent;

the polyester resin having an acid value of not more than 10 mgKOH/g and a hydroxyl value of not more than 40 mgKOH/g; and the functional group being present in a proportion of 2 to 5mol % in the resin.

2. An electrophotographic toner according to claim 1, wherein the coloring agent comprises a carbon black having a specific surface area of 100 to 250 $m^2/g$ based on BET method.

3. An electrophotographic toner according to claim 1, wherein a carbon black having a specific surface area of 110 to 250 $m^2/g$ based on BET method is contained.

4. An electrophotographic toner according to claim 1, wherein the fine particle of titanium oxide is added to the toner particle defined in claim 1, which contains the polyester resin and the electric charge control resin, in an amount of 0.1 to 2 parts by weight for 100 parts by weight of the toner particle.

5. An electrophotographic toner according to claim 1, wherein the polyester resin is obtained by polycondesation of a carboxylic acid or ester thereof and a dihydric alcohol.

6. An electrophotographic toner according to claim 1, wherein the polyester resin is obtained by polycondensation of a dihydric alcohol and a dicarboxylic acid or ester thereof.

7. An electrophotographic toner according to claim 1, wherein the polyester resin is a reaction product of at least a dicarboxylic acid or ester thereof and a dihydric alcohol.

8. An electrophotographic toner according to claim 1, wherein the acid value is not more than 10 mgKOH/g and not less than 2.5 mgKOH/g.

* * * * *